United States Patent [19]

Bowman

[11] 4,184,212

[45] Jan. 22, 1980

[54] LIFT-FRONT FIREFIGHTER'S HOOD

[75] Inventor: J. Robert Bowman, Hooksett, N.H.

[73] Assignee: Globe Manufacturing Co., Pittsfield, N.H.

[21] Appl. No.: 939,693

[22] Filed: Sep. 5, 1978

[51] Int. Cl.[2] ..... A42B 3/00; E05C 3/04; A62B 17/04

[52] U.S. Cl. ..... 2/5; 292/67; 292/202

[58] Field of Search ..... 2/7, 8, 10, 424, 2.1 R, 2/2.1 A; 292/67, 202

[56] References Cited

U.S. PATENT DOCUMENTS

| | | | |
|---|---|---|---|
| 1,075,653 | 10/1913 | Klister et al. . | |
| 1,198,862 | 9/1916 | McCormack | 292/67 |
| 1,608,588 | 11/1926 | Dundek et al. . | |
| 2,377,122 | 5/1945 | Bakke | 128/142 |
| 2,517,600 | 8/1950 | Ruhl | 2/8 |
| 2,801,868 | 8/1957 | Carson | 292/202 |
| 2,882,894 | 4/1959 | Fahey et al. | 2/8 X |
| 3,013,273 | 12/1961 | Kamperin | 2/5 |
| 3,584,313 | 6/1971 | Brown et al. | 2/2.1 R |
| 3,876,237 | 4/1975 | Hayes et al. | 292/202 |
| 3,929,360 | 12/1975 | Gulistan | 292/67 |

FOREIGN PATENT DOCUMENTS 681314 10/1952 United Kingdom .

*Primary Examiner*—Louis Rimrodt

*Attorney, Agent, or Firm*—Watson, Cole, Grindle & Watson

[57] ABSTRACT

Disclosed is a lift-front type hood adapted for use by firefighters which has an improved latching means. The hood comprises a helmet including a bump cap capable of fitting onto the top of the head of a wearer and a rigid liner attached to the bump cap and extending down from the front of the cap so as to be in front of the face of a wearer, the liner having an opening therein so as to allow a wearer to have vision. The hood further includes a shroud of flexible material attached to the exterior of the helmet and extending about the helmet so as to form a generally cylindrical skirt about the head and upper torso of a wearer, the shroud having an opening therein coextensive with the opening in the liner, and a shield plate comprising a sheet of transparent material covering the opening in the liner and shroud and attached to the liner by hinges. A rotatable latch is on the shield plate which comprises a shaft projecting through a hole in the shield plate, handle means on the end of the shaft on the exterior of the shield plate, and a transverse arm on the other end of the shaft capable of engaging the edge of the opening of the liner so as to lock the shield plate over the opening in the liner and shroud.

6 Claims, 3 Drawing Figures

FIG. 1
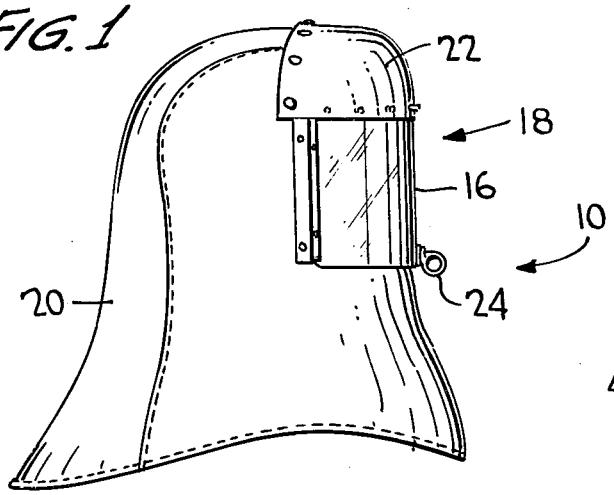
FIG. 3
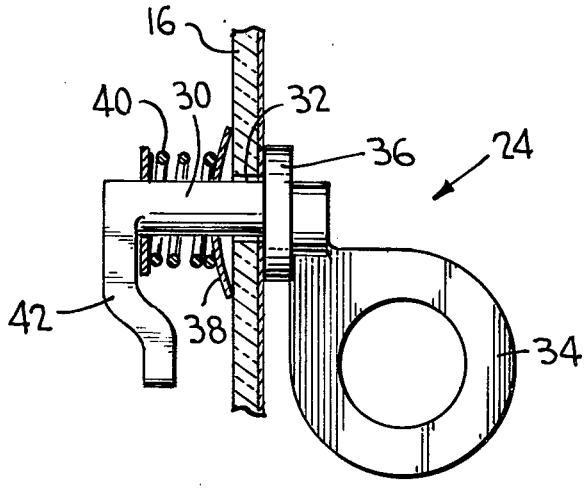
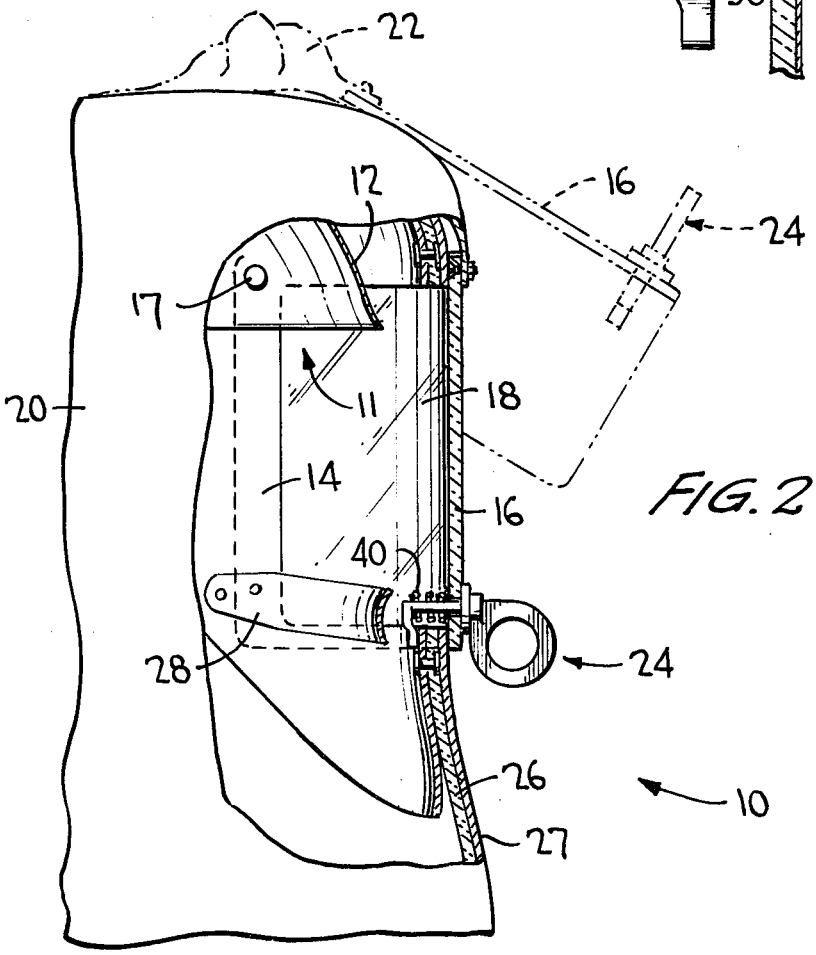
FIG. 2

LIFT-FRONT FIREFIGHTER'S HOOD

BACKGROUND OF THE INVENTION

The present invention relates generally to hoods adapted for use by firefighters and more particularly, to lift-front type hoods having an improved latching means for positively locking the shield plate of the hood in the closed position.

Conventional firefighter's hoods generally comprise a rigid protective helment with an overlying shroud of fire-retardant fabric which encloses and thereby protects the head and upper torso of the wearer from heat, flames, smoke and falling or flying objects. An opening is provided in the front portion of the shroud to enable the wearer to see outwardly from the hood, the opening being covered by a transparent shield plate so as to provide a complete enclosure for the head of the wearer. Since such a hood has limited ventilation, the shield plate is oftentimes hinged to the remainder of the hood thereby forming a so called lift-front hood as the shield plate may be swung up from the shroud to provide increased ventilation and comfort when the wearer is not actually fighting a fire.

To help prevent the shield plate from being accidentally opened from the shroud when the protection of the shield plate is necessary, a latch has been provided at the bottom of the shield plate to secure the plate to the shroud. One known latch comprises a spring-like catch on an extension of the shield plate and a cooperating post projecting from the shroud which has an enlarged end. To secure the shield plate in the closed position, the catch is brought into contact with the post and the spring-like catch forced over the enlarged end of the post.

A significant disadvantage of this known latch for hoods is that the shield plate can be accidentally opened by an object striking or brushing by the shield plate in the outward direction since the latch is only secured by the force of the spring-like catch about the post. If a wearer of the hood were in the midst of a hazardous firefighting situation, the accidental opening of the shield plate could subject the wearer to serious burns to the face, could expose the wearer to injury from flying or falling objects, or could greatly increase the inhalation of smoke by the wearer. Clearly such consequences are not desirable.

SUMMARY OF THE INVENTION

It is therefore an object of the present invention to provide a lift-front type hood adapted for use by firefighters which includes a latch which can positively lock the shield plate of the hood in a closed position.

Another object of the present invention is to provide a lift-front type hood which includes a latch which can be easily manipulated to either lock or unlock the shield plate to the hood.

A further object of the invention is to provide a lift-front type hood which includes a latch of simple and durable construction and which can be easily removed from a shield plate.

Briefly, these objects are achieved by the present invention which comprehends a hood adapted for use by firefighters comprising a helmet including a bump cap capable of fitting onto the top of the head of a wearer and a rigid liner attached to the bump cap and extending down from the bump cap so as to be in front of the face of a wearer, the liner having an opening therein so as to allow a wearer to have vision, a shroud of flexible material attached to the exterior of the helmet and extending about the helmet so as to form a generally cylindrical skirt about the head and upper torso of a wearer, the shroud having an opening therein coextensive with the opening in the liner, a shield plate comprising a sheet of transparent material covering the opening in the liner and shroud and attached to the liner by hinges, and a rotatable latch on the shield plate comprising a shaft projecting through a hole in the shield plate, handle means on the end of the shaft on the exterior of the shield plate, and a transverse arm on the other end of the shaft capable of engaging the edge of the opening of the liner so as to lock the shield plate over the opening in the liner and shroud.

Further objects, advantages and features of the present invention will become more fully apparent from a detailed consideration of the arrangement and construction of the constituent parts as set forth in the following specification taken together with the accompanying drawing.

BRIEF DESCRIPTION OF THE DRAWINGS

In the drawing,

FIG. 1 is a side view of one embodiment of a lift-front type hood for firefighters in accordance with the present invention, FIG. 2 is a more detailed view of the hood of FIG. 1, portions of the hood being shown in cross-section, and FIG. 3 is an enlarged view, partially in cross-section, of the latch and shield plate of the hood of FIG. 1.

DETAILED DESCRIPTION OF THE PREFERRED EMBODIMENT

Referring now to FIGS. 1 and 2, shown is a side view of a firefighter's hood 10 in accordance with the present invention. Hood 10 is adapted to be placed over the head of a wearer so as to help protect the upper torso and head of the wearer from flames, smoke, heat, falling and flying objects and the like while fighting a fire.

Hood 10 includes a helmet 11 comprising rigid bump cap 12 which is adapted to fit on top of the head of a wearer and which may include a web type suspension (not shown) within the cap and a chin strap (not shown) for maintaining the cap in the proper position and for increasing the protection provided for the wearer.

Helmet 11 of hood 10 also includes a rigid liner member 14 pivotly attached to bump cap 12, the member extending down from the front of the bump cap so as to protect the face of a wearer. Liner member 14 is of a generally semi-cylindrical configuration which helps protect the face of a wearer from all sides and includes rectangular opening 16 which allows the wearer to see outwardly from the hood. Transparent shield plate 16 also of a generally semi-circular configuration is attached to liner member 14 by pivots 17 such that the shield plate may cover opening 18 in the liner member when in the closed position and also may be lifted upwardly so as to allow the wearer to have unobstructed vision and increased ventilation within the hood.

Covering helmet 11 is shroud 20 of flexible fire-resistant material or fabric. Shroud 20 extends about helmet 11 so as to form a generally cylindrical skirt about the head and upper torso of a wearer of hood 10. Shroud 20 also has an opening coextensive with the opening 18 in liner member 14. Attached to the upper portion of shroud 20 and the top edge of shield plate 16 is flexible water deflector 22 which helps to seal the space between the shroud and the top edge of the shield plate. Shroud 20 and water deflector 22 are flexible laminates of outer heat-reflecting metallized fabric 26 and inner wool-like heat insulating material 27.

As is evident from FIG. 2, shield plate 16 in the down position is locked to liner member 14 by latch 24 which projects through the shield plate and engages the edge of the liner member forming opening 18. Once shield plate 16 is locked against liner member 14 by latch 24, the head of a wearer of hood 10 is thus protected from all directions. Attached to the inner portion of liner member 14 near opening 18 is curved bar 28 which is spaced from latch 24 and thereby prevents the chin of a wearer from the inwardly projecting portion of the latch if an object should strike or jolt hood 10 and cause the hood to shift in position.

The specific construction of latch 24 is more clearly shown in the partial cross-sectional view of FIG. 3. Shaft portion 30 of latch 24 projects through hole 32 in shield plate 16 with handle portion 34 of the latch on the exterior of the shield plate. Handle portion 34 is in the shape of a ring and is large enough so as to allow latch 24 to be manipulated easily by a gloved hand. The ring shape of handle portion 34 also provides a convenient means for hanging hood 10 on a hook or the like when not being used.

Stop means in the form of an enlargement 36 on shaft portion 30, spring washer 38 and helical spring 40 prevent axial displacement of latch 24 relative to shield plate 16. Latch 24 further includes transverse arm portion 42 which is adapted to engage liner member 14 upon proper rotation of shaft portion 30. The end of arm portion 42 is offset inwardly toward shield plate 16 so as to facilitate the latching operation. Preferably, shaft portion 30, enlargement 36, handle portion 34 and arm 42 of latch 24 are of integral construction.

While the materials used for the components of hood 10 are not believed to be critical, in a presently preferred embodiment, bump cap 12 and liner member 14 are of impact resistant fiberglass type material, shroud 20 and water deflector 22 are of a fire retardant aluminized aramid fabric sold under the tradename Nomex, shield plate 16 is of a transparent polymethacrylate or carbonate polymer and preferably has a heat-reflecting gold plated film on the outer surface, and latch 24 is of cast aluminum.

When hood 10 is being worn, shield plate 16 of the hood in accordance with the present invention can be either in the up or open position as shown by the dashed lines in FIG. 2 or can be in the closed position to provide increased protection for a firefighter from flames, heat, smoke and falling objects. A distinct advantage of hood 10 is that latch 24 provides positive locking of shield plate 16 in the closed position yet allows the shield plate to be easily opened by a simple rotation of handle portion 34.

A further advantage of hood 10 is that if shield plate 16 becomes damaged or broken, latch 24 can be readily removed from the shield plate and installed in a new shield plate. Thus, repair of a damaged hood 10 in the field is greatly facilitated.

While the present invention has been described with reference to a particular embodiment thereof, it will be understood that numerous modifications may be made by those skilled in the art without actually departing from the spirit and scope of the invention as defined in the appended claims.

I claim:

1. A hood adapted for use by firefighters comprising a helmet including a bump cap capable of fitting onto the top of the head of a wearer and a rigid liner attached to the bump cap and extending down from the front of the cap so as to be in front of the face of a wearer, the liner having an opening therein so as to allow a wearer to have vision, a shroud of flexible material attached to the exterior of the helmet and extending about the helmet so as to form a generally cylindrical skirt about the head and upper torso of a wearer, the shroud having an opening therein coextensive with the opening in the liner, a shield plate comprising a sheet of transparent material covering the opening in the liner and shroud and attached to the liner by hinges, and a rotatable latch on the shield plate comprising a shaft projecting through a hole in the shield plate, handle means on the end of the shaft on the exterior of the shield plate, and a transverse arm on the other end of the shaft capable of engaging the edge of the opening of the liner so as to lock the shield plate over the opening in the liner and shroud.

2. A hood according to claim 1 wherein the rotatable latch includes spring means for holding the latch relative to the shield plate.

3. A hood according to claim 2 wherein the spring means includes a spring type washer and a helical spring.

4. A hood according to claim 1 wherein the end portion of the transverse arm is offset relative to the remainder of the arm.

5. A hood according to claim 1 wherein the shaft, handle means and transverse arm of the latch are integral.

6. A hood according to claim 1 wherein the handle means of the latch is ring shaped.

* * * * *